US007086642B1

(12) United States Patent
O'Brien

(10) Patent No.: US 7,086,642 B1
(45) Date of Patent: Aug. 8, 2006

(54) RACKABALE GATE FOR FENCE AND METHOD OF PRODUCING SUCH

(75) Inventor: James R. O'Brien, Alpharetta, GA (US)

(73) Assignee: XFM, Inc., Alpharetta, GA (US)

( * ) Notice: Subject to any disclaimer, the term of this patent is extended or adjusted under 35 U.S.C. 154(b) by 0 days.

(21) Appl. No.: 10/609,083

(22) Filed: Jun. 27, 2003

Related U.S. Application Data

(63) Continuation-in-part of application No. 10/027,203, filed on Dec. 26, 2001.

(60) Provisional application No. 60/258,220, filed on Dec. 26, 2000.

(51) Int. Cl.
*E04H 17/14* (2006.01)

(52) U.S. Cl. ..... 256/73; 256/22; 256/24; 256/60; 256/67; 49/50; 49/54; 49/56

(58) Field of Classification Search ..... 256/22, 256/24, 26, 67, 65.11, 65.12, 73; 49/50, 49/54–57

See application file for complete search history.

(56) References Cited

U.S. PATENT DOCUMENTS

| | | | | |
|---|---|---|---|---|
| 1,757,686 A | | 5/1930 | Rosenbaum | 256/72 |
| 2,628,441 A | * | 2/1953 | Enghauser | 49/237 |
| 3,067,985 A | * | 12/1962 | Cusack | 256/67 |
| 3,357,681 A | * | 12/1967 | Souza, Jr. | 256/65.02 |
| 3,456,921 A | | 7/1969 | Hinkle | 256/22 |
| 3,638,710 A | * | 2/1972 | Sundermann | 49/288 |
| 4,074,893 A | | 2/1978 | Coltrin | 256/21 |
| 5,161,783 A | * | 11/1992 | German | 256/65.12 |
| 5,544,866 A | | 8/1996 | Dye | 256/69 |
| 5,592,717 A | * | 1/1997 | Longo | 49/236 |
| 5,645,271 A | | 7/1997 | Nunez | 256/67 |
| 5,868,382 A | * | 2/1999 | Groves | 256/73 |
| 5,971,365 A | | 10/1999 | Pigott et al. | 256/65 |
| 6,073,396 A | * | 6/2000 | Kietzmann | 49/236 |
| 6,464,209 B1 | * | 10/2002 | Meis et al. | 256/73 |
| 6,711,853 B1 | * | 3/2004 | Bergstrom | 49/56 |
| 6,811,145 B1 | * | 11/2004 | Gibbs et al. | 256/73 |

FOREIGN PATENT DOCUMENTS

| | | | |
|---|---|---|---|
| AU | 9944656 A | | 3/2000 |
| DE | 19648179 A1 | * | 4/1998 |
| FR | 1061340 | | 4/1954 |
| FR | 2799671 A1 | * | 4/2001 |
| GB | 1364885 A | | 6/1974 |
| GB | 2299100 A | | 9/1996 |

* cited by examiner

*Primary Examiner*—Daniel P. Stodola
*Assistant Examiner*—Ernesto Garcia
(74) *Attorney, Agent, or Firm*—Baker, Donelson, Bearman, Caldwell & Berkowitz, PC

(57) ABSTRACT

A rackable gate having a gate panel with spaced-apart rails connected to a plurality of first pickets and a second picket. The second picket attaches to the respective rails on a side edge opposing the attachment of the first pickets to the rail. Distal opposing ends of the rails are received and pivotally secured in openings defined in opposing gate posts. The gate racks or moves so that the rails are disposed at an oblique angle relative to the pickets. The opposing fastening of the second picket and the opposing distal end of the rail received in the post restrict the rail from pivoting away from the pickets when the panel is racked to track the contour of the terrain. A method of making a rackable gate is disclosed.

14 Claims, 6 Drawing Sheets

RACKABALE GATE FOR FENCE AND METHOD OF PRODUCING SUCH

The present application is a continuation-in-part of co-pending application Ser. No. 10/027,203, filed Dec. 26, 2001, a continuation-in-part of provisional application Ser. No. 60/258,220, filed Dec. 26, 2000.

TECHNICAL FIELD

This invention relates to fencing and methods of producing fencing, and more particularly, the present invention relates to gates for rail and picket fencing which are selectively angled on-site to conform the slope of the gate to the slope of an underlying terrain.

BACKGROUND OF THE INVENTION

Fencing has existed for many years. In particular, wrought iron fencing or the like has been developed to produce a more decorative type of fencing. This type of fencing comprises a series of vertical pickets which are attached to horizontal rails. In some known types of wrought iron fencing, the rails have holes through which the pickets extend. Screws connect the pickets attach to the rails with screws or by welding.

In the past, wrought iron fencing erected upon a sloping terrain was typically produced on-site by planting several spaced-apart vertical posts, mounting the rails to the posts at an angle generally parallel to the sloping terrain, and mounting the vertical pickets to the rails. This method of producing fencing is time consuming and inefficient.

To meet the need for providing fencing that conforms to the slope of the terrain, wrought iron fencing has been custom manufactured. The terrain to be fenced is measured to determine the slopes. Plats are marked, and custom fence sections manufactured. These have to be labeled in order to track the location and sequence during installation. However, during the manufacturing, the terrain may have changed. For example, a pool area to be fenced may change due to subterranean problems such as rocks and the like uncovered during installation of the pool. The area to be fenced thus may change or be re-graded. This results in re-work or scrap sections of fencing, which increases the costs of the fencing.

Recently, fencing has been produced off-site wherein the rails and pickets are all mounted together to form a panel. The pickets are welded to the rails with the use of a top weld between the picket and the top rail and a bottom weld between the picket and the bottom edge of the bottom rail, as shown in prior art FIG. 6. (In other embodiments, the pickets and the rails are secured with screws.) The fence panel is then transported to the erection site and installed. To track or conform to the slope of the terrain, the panel is shifted (or in the term of the art, racked, so that the pickets remain substantially vertical and rails are oriented substantially parallel to the sloping terrain. The fence panel is racked so that the rails are allowed to be reoriented with respect to the pickets thereon through the use of a mild steel weld (or screws) which allow flexing of the weld.

While this shifting of the fence panel has worked fairly well when shifting only a small amount or a few degrees, there is a problem with more significant changes in the angle of the rails relative to the pickets. When the panel is shifted to a large degree, the rails tend to roll or rotate on the unwelded side and thereby partially separate or pull themselves away from the pickets. The rails and pickets there are not flush to each other and the fence has unsatisfactory gaps at the connections between the rails and the pickets. The gaps weaken the fence panel and are unsightly. My prior patent application Ser. No. 10/027,203, filed Dec. 21, 2001, discloses an improved fencing panel that that can be produced off-site and shifted during assembly on-site without causing the rails to separate from the pickets.

While this improved fencing has meet with success in providing picket fencing that readily conforms to the contour of the terrain, gates remain a problem. The gates are made of rigid panels and when installed on contoured terrain, define a "stepped" appearance to the fencing rather than a smoothly continuous tracking of the contour.

Accordingly, a need remains for a fencing gate that can be produced off-site and shifted during assembly on-site without causing the rails to separate from the pickets. It is to the provision of such that the present invention is primarily directed.

BRIEF DESCRIPTION OF THE PRESENT INVENTION

The present invention meets the need in the art by providing a rackable gate that readily adjusts to conform substantially to a slope of a terrain during installation. The rackable gate comprises a gate panel with a pair of spaced-apart rails connected to a plurality of spaced-apart first and second pickets on a side of the rails. The rails have a first edge and a spaced apart second edge on the side. The first pickets attach with a fastener only between the respective first picket and the first edge of the respective rail. The second picket attaches to the respective rails with a fastener only between the second picket and the second edge of the respective rail. A pair of opposing gate posts each define openings in a side wall, and the openings are spaced-apart to conform to the spacing of the rails. The openings receive opposing distal ends of the rails which are pivotally secured thereat. During racking of the gate panel to orient the rails at an oblique angle relative to the pickets to track the contour of the terrain, the rails are restricted from pivoting from the pickets by the fastening of the second picket opposing the fastening of the first pickets and the opposing distal ends of the rail received in the gate posts.

In another aspect, the present invention provides a method of making a gate for tracking a sloped grade during installation of a fence over a terrain, comprising the steps of:

(a) disposing a first rail parallel and spaced-apart from a second rail at an angle to a horizontal plane to define a longitudinal length of a fence panel, the rails defining on a lateral side opposing first and second side edges;

(b) attaching a plurality of first pickets on the lateral side of the rails substantially perpendicular to the horizontal plane with fasteners only between the respective picket and the first side edge of the respective rail;

(c) attaching at least one second picket on the lateral side of the rails substantially perpendicular to the horizontal plane by fasteners only between the second picket and the second side edge of the respective rail; and (d) pivotally securing distal ends of the rails in openings defined in opposing posts, whereby the gate, being racked by moving the opposing posts in opposing directions transverse to the longitudinal axis of the rails, conforms the slope of the rails substantially to the slope of the portion of the terrain by changing the angle between the first and second pickets and the rails while the first and second pickets remain substantially perpendicular to horizontal.

Objects, features, and advantages of the present invention will become apparent from a reading of the following detailed description of the invention and claims in view of the appended drawings.

DETAILED DESCRIPTION

Figure 1:
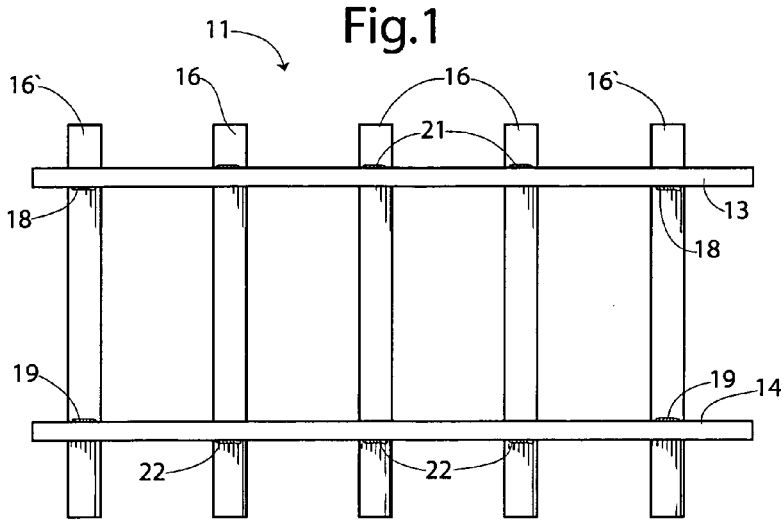
FIG. 1 is a rear side view of a fence panel embodying principles of the invention in a preferred form.
Figure 2:
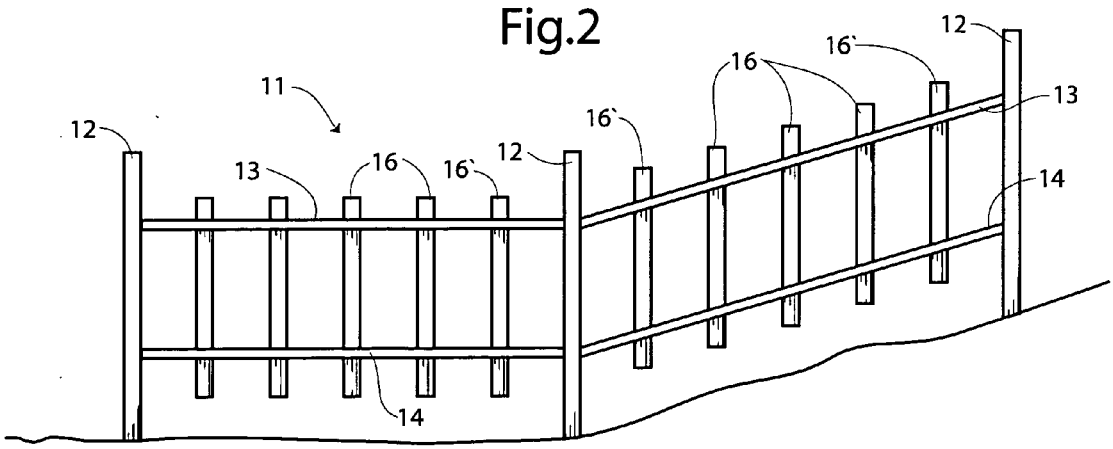
FIG. 2 is a side view of the fence of FIG. 1, shown erected upon a sloping terrain.

Referring now in more detail to the drawings, in which 15 like numerals indicate like parts throughout the several views, FIG. 1 illustrates a fence 10 embodying principles of the invention in a preferred form. The fence 10 has a series of panels or sections 11 mounted to a series of posts 12. Each section 11 includes a top rail 13, a bottom rail 14, and a series of pickets 16 mounted to the top rail 13 and bottom rail 14. Each rail 13, 14 defines a lower side edge 25 and an upper side edge 26 which side edges abut against a face of the pickets 16 (see FIG. 3), for a purpose discussed below. In the illustrated embodiment, the rails and pickets are metal. The outermost pickets 16' and 16' of each section 11 mount or fasten to the top rail 13 with a lower, flexible, mild steel weld 18 extending along the lower edge 25 of the top rail 13, and mount to the bottom rail 14 with an upper, flexible, mild steel weld 19 extending along the upper edge 26 of the bottom rail 14. The outer pickets 16' thus connect to the rails 13, 14 with opposing welds 18, 19 on the opposing side faces 25, 26. Each inner picket 16 of each section 11 mounts to the top rail 13 with an upper, flexible, mild steel weld 21 extending along the upper edge 26 of the top rail 13, and mount to the bottom rail 14 with a lower, flexible, mild steel weld 22 extending along the lower edge 25 of the bottom rail 14.

It has been found that a section 11 of fence manufactured in this manner may be shifted up to approximately 30 degrees, with respect to the angle between the pickets and the rails, although about 20 degrees is the preferable limit, without causing the rails 13 and 14 to twist or rotate and thereby separate from the pickets 16.

Figure 3:
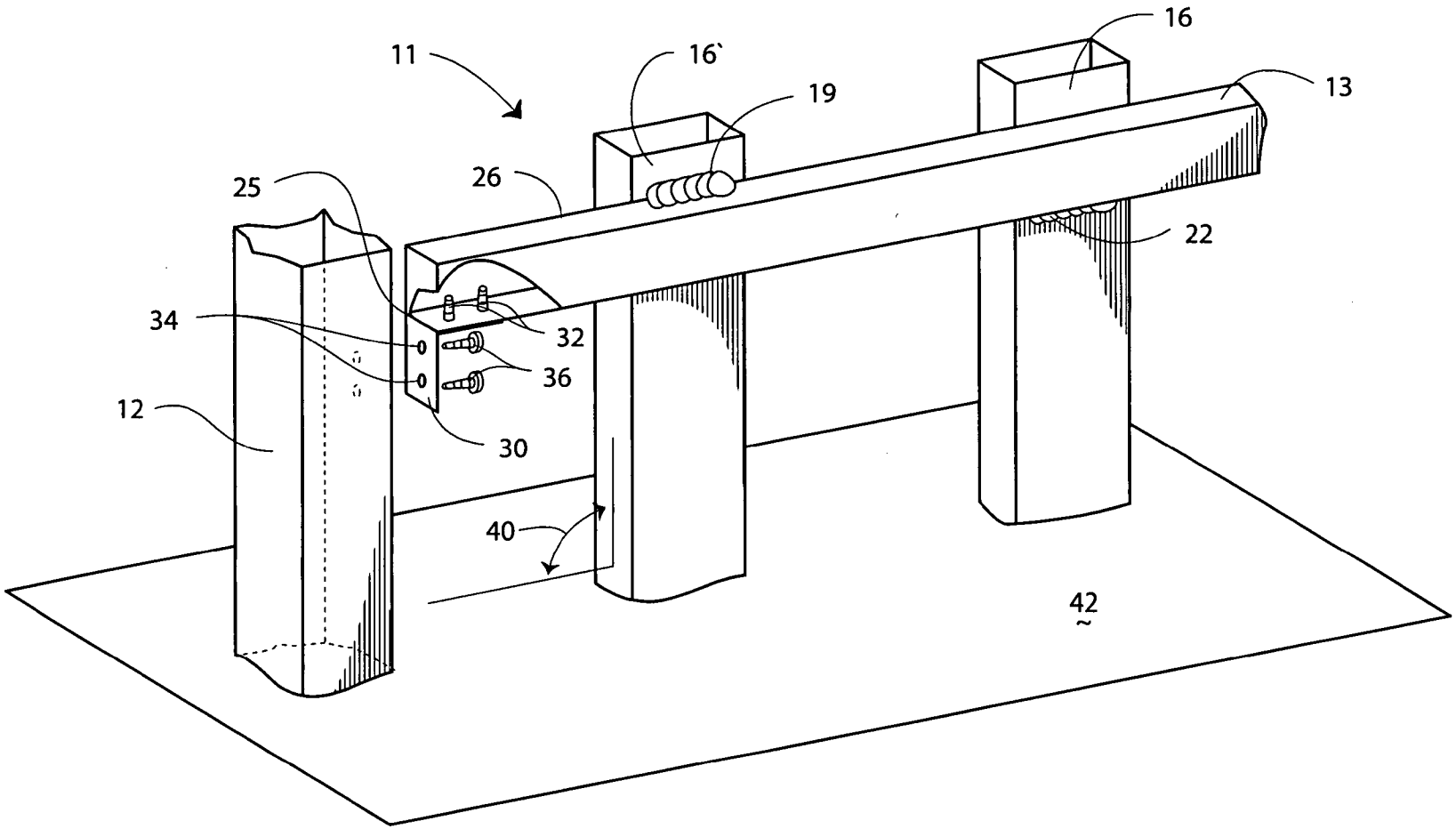
FIG. 3 is a detailed perspective view of an embodiment of the present invention prior to installation.

FIG. 3 is a detailed perspective view of an embodiment of the fence section 11 of the present invention prior to installation. An angle member 30 with angled legs attaches such as with screws 32 to distal ends of the rails 13, 14. A free leg defines holes 34 that receive screws 36 for securing the fence section 11 to fence posts 12. Another of the fence sections 11 readily connects to the post 12 to for a continuous length of fence 10. In the embodiment illustrated in FIG. 3, it is to be 10 appreciated that the welds securing the rails and pickets (welds 18, 19 and 21, 22 are switched), but maintain their opposing nature which facilitates the capability of the fence: section 11 to be reoriented during installation. In this illustrated embodiment, the outer picket 16' connects to the 15 upper rail 13 with the weld 19 on the upper side edge 26 and the inner pickets 16 connect by welds 22 at the lower side edge 25. Not illustrated is the opposing rail 14 in which the orientation of the welds 18, 19 and 21, 22 connecting the pickets 16, 16' to the rail 14 is likewise changed to maintain the opposing relations. The lower rail 14 in this embodiment connects to the outer pickets 16' with the weld 18 on the lower side edge 25 and the inner pickets 16 connect with the weld 21 on the upper side edge 26. The pickets 16, 16' are disposed substantially perpendicular 40 to a horizontal plane 42 (such as a terrain surface with no slope). The rails 13, 14 are disposed parallel to the horizontal plane 42, or the orientated at 0 degrees elevation.

Figure 4:
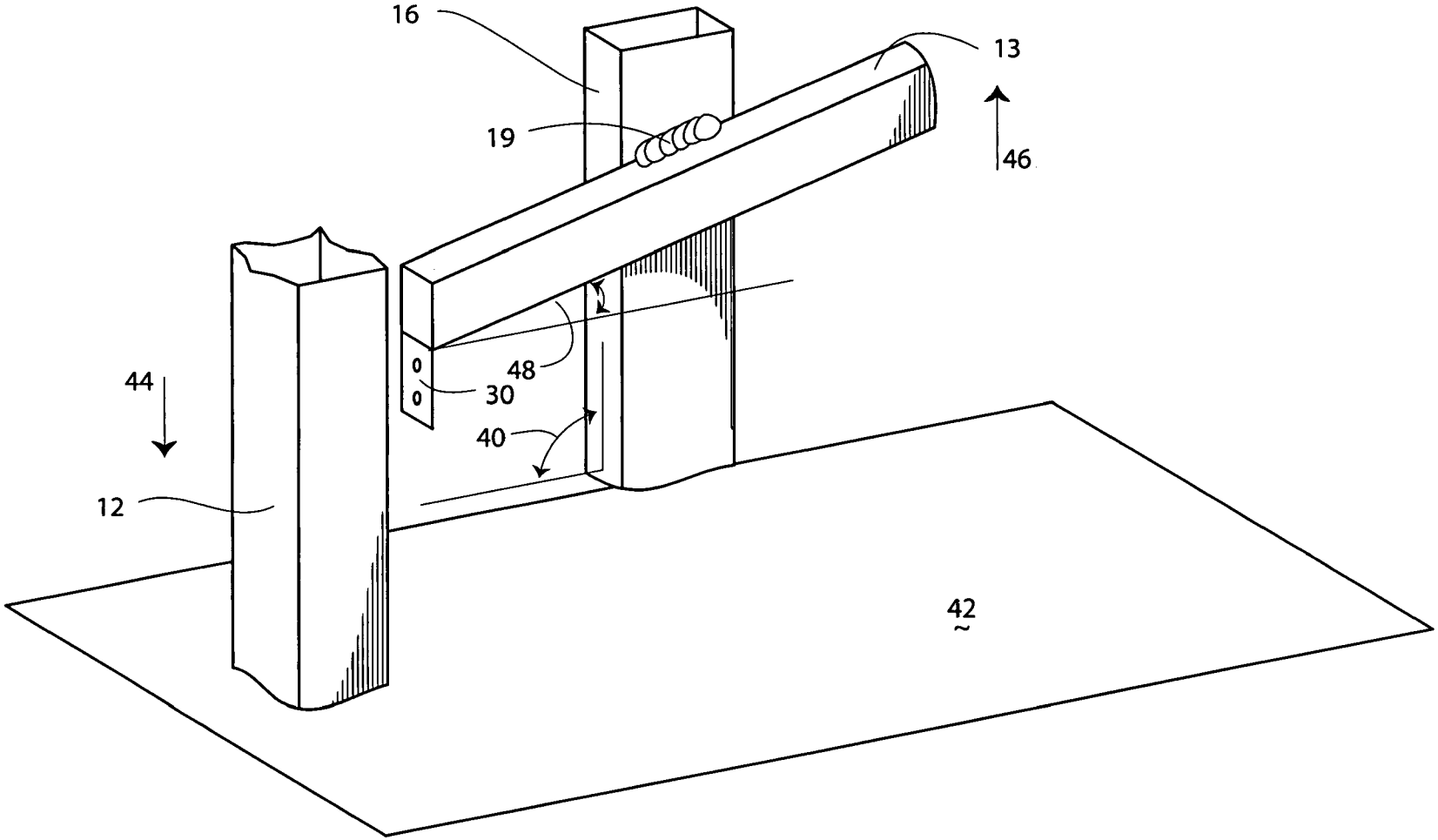
FIG. 4 is a detailed perspective view of the embodiment illustrated in FIG. 3 showing the racking of the fence panel during installation.

FIG. 4 is a detailed perspective view of the embodiment illustrated in FIG. 3 showing the racking of the fence panel 11 during installation. The opposing ends of the fence section 11 are moved in opposing relative directions transverse to the longitudinal axis of the rails, as indicated by the arrows 44, 46. The mild welds 18, 19, and 21, 22 allow the pickets 16, 16' to flexibly move relative to the rails 13, 14. This disposes the rails 13, 14 at an angle 48 of elevation relative to the horizontal plane 42 conforming substantially to the slope of the terrain, while the pickets 16, 16' remain generally substantially perpendicular to the horizontal plane 42 (or terrain). Generally, the angle 48 is limited to about 20 degrees of flexible re-orientating of the rails and the pickets, although may be as high as about 30 degrees.

To provide a greater variance in fencing, each section 11 may also be manufactured at a pre-selected angle between the pickets 16 and the rails 13 and 14. As such, a fencing having a pre-selected angle of 30 degrees may be shifted a maximum of 30 degrees so as to provide fencing which may be mounted to a certain angle having a range of between 0 degrees and 6 degrees from horizontal. It has been found however, that about 20 degrees is the preferable maximum. At about 25 degrees of change, the pickets 16, 16' begin to have visually detectable appearances of slight distortion, as the distance between the distal ends of the vertical pickets changes due to 1 the racking. This change in span, while slight, is induced by the different axis of rotation of the welds 18, 19 for the outer pickets 16' than for the welds 21, 22 for the inner pickets 16. Accordingly, a series of fence sections 11 having the rails 13, 14 at an angle selected from the group of 0 j degrees, 20 degrees, 40 degrees, and 60 degrees (relative to a horizontal plane) appropriately allows these sections to be placed in fences 10 on terrain of 0 to about 80 degrees.

Figure 5:
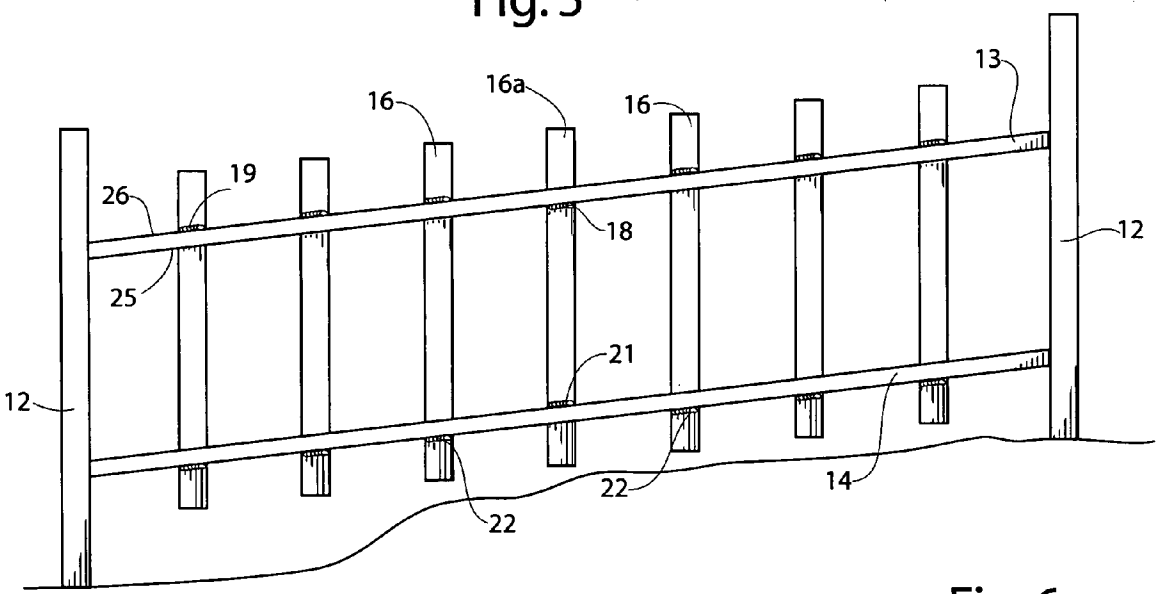
FIG. 5 is a rear side view of a fence section according to the present invention with one picket having reversed I fastening from the other pickets in the fence section.
Figure 6:
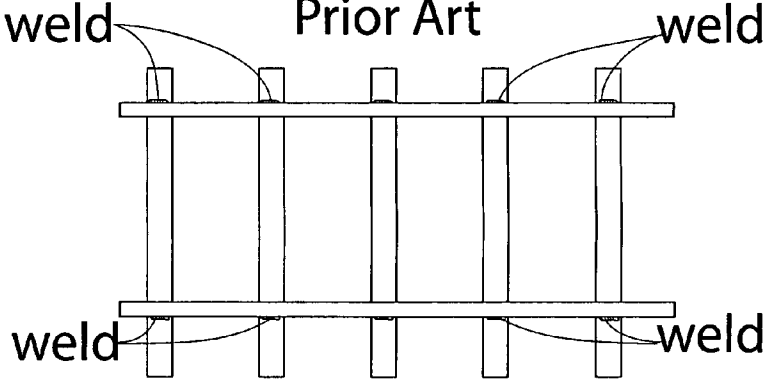
Fig. 6 Prior Art
FIG. 6 is a side view of a fence panel of the prior art.

In the illustrated embodiment, the pickets 16, 16' are spaced uniformly apart. In an alternate embodiment, the pickets 16, 16' have different spans which may contribute different ornamental appearances. While the disclosed embodiment has the fastening welds reversed as to the outer pickets 16' from the fastening welds for the inner pickets 16, the racking capability of the present invention will also be found in embodiments in which the pickets with the reversed fastening are spaced inwardly from the outermost pickets. Preferably, two pickets spaced-apart have the reversed fastening from the other pickets in the fence section. It is believed however that limited degrees of racking would be available in an embodiment having at least one picket with reversed fastening to the rails. For example, FIG. 5 is a rear side view of a fence section according to the present invention with one picket 16*a* having reversed fastening from the other pickets in the fence section. Further, while the disclosed fence section is manufactured of wrought iron, the picket and rail racking fence section can be readily assembled with pickets and rails of other materials, including plastic, wood, or other materials, given that the rails fasten to the pickets with 1 fasteners to fix a connection therebetween with at least one but preferably two pickets having reversed fastening. Fasteners other than welds can be used to fix the connection between the rails and the pickets. For example, in an embodiment with wood members, the fastening is accomplished with screws at the side edges of the rails as disclosed herein.

Figure 7:
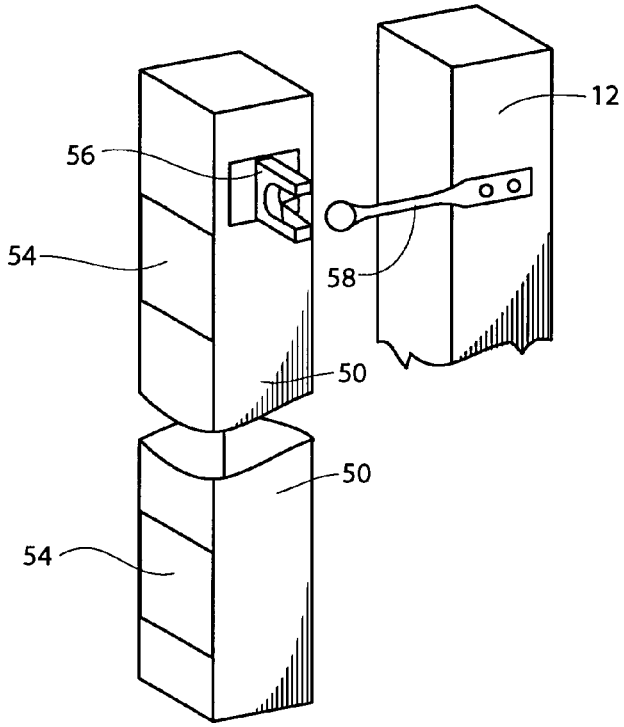
FIG. 7 is a perspective view of a post used with the fence panel illustrated in FIG. 1 to assemble a rackable gate embodying principles of the present invention.

In accordance to the present invention, the fence panel 11 also readily assembles with a pair of posts 50 shown in FIG. 7 to form a gate 52 (illustrated in FIG. 10) that racks to conform to the contour of sloping terrain that receives a fence. The post 50 defines spaced-apart openings 54 in a side wall. The openings 54 are spaced-apart in the post 50 a distance equal to the distance between the opposing rails 13, 14 in the fence panel 11. The openings 54 receive free distal ends of the rails 13, 14 of the fence panel 11 as discussed below. The rails pivotally connect to the opposing posts 50. Hinges and latches attach to the post 50 as appropriate for opening and latching the gate 52, as discussed below. FIG. 7 illustrates a conventional latch 56 attached to the post 50 and engagable with a latch member 58 attached to an adjacent post 12 of the fence panel 11.

Figure 8:
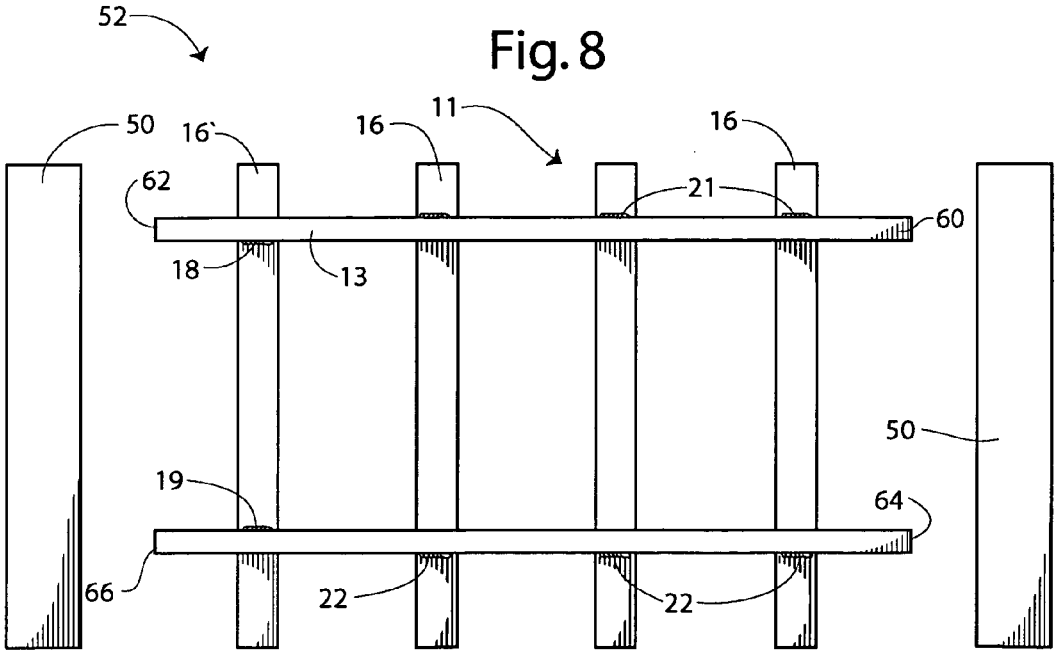
FIG. 8 is a rear side view of a fence panel exploded away from opposing posts illustrated in FIG. 7 used to assemble a rackable gate.
Figure 9:
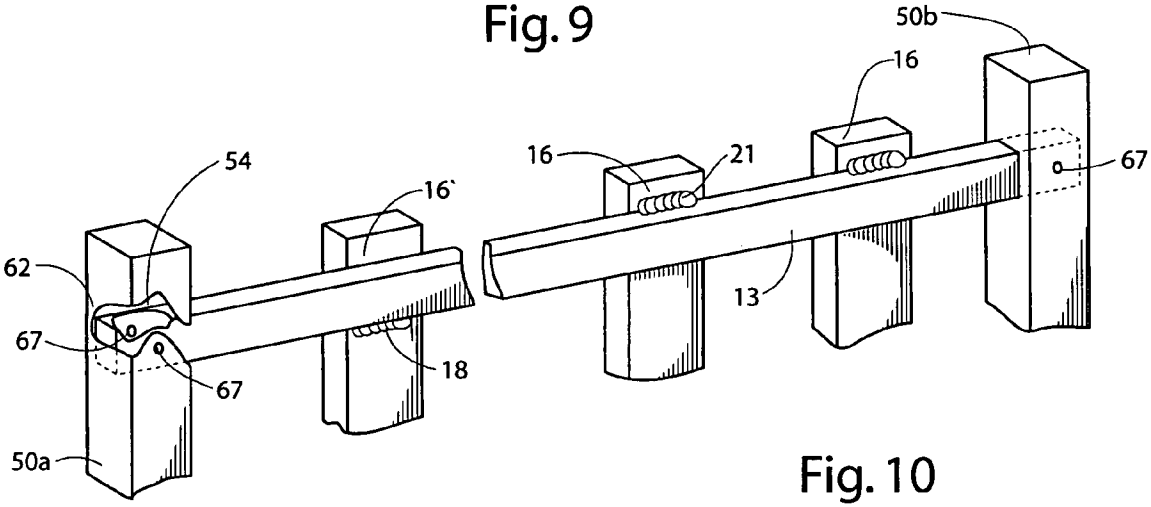
FIG. 9 is a detailed perspective view of a portion of the fence panel and opposing posts assembled to form a rackable gate.

FIG. 8 is a rear side view of the fence panel 11 exploded away from opposing posts 50. The fence panel 11 as described above is cut to length for the gate 52, resulting in a cut panel having a plurality of inner pickets 16 (or a plurality of first pickets) and one outermost picket 16' (or one second picket) attached to the rails 13, 14. The weld 18 securing the picket 16' to the rail 13 opposes the welds 21 securing the pickets 16 to the rail 13. The weld 19 securing the picket 16' to the rail 14 opposes the welds 22 securing the pickets 16 to the rail 14. Cutting the fence panel 11 leaves the rails 13, 14 with opposing distal ends 60, 62 and 64, 66. The openings 54 in the opposing posts 50 receive the distal ends 60, 64 and 62, 66 of the respective rails 13, 14. FIG. 9 is a detailed perspective view of an upper portion of the fence panel 11 with the distal ends 60, 62 received in the openings 54 of the opposing posts 50 upon assembly to form the rackable gate 52. The distal ends are fastened to the respective post 50. In the illustrated embodiment, rivets 67 are used to secure the rails 13, 14 to the posts 50.

Figure 10:
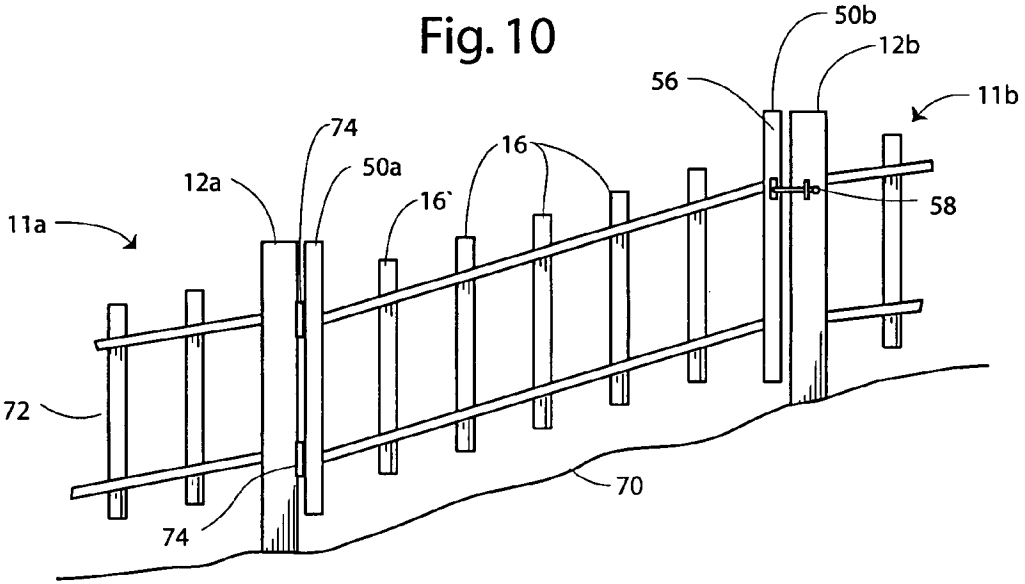
FIG. 10 is a side view of the assembled gate racked to the contour of sloping terrain in a fence.

FIG. 10 is a side view of the assembled gate 52 racked to the contour of sloping terrain 70 in a fence 72. The welds 18, 19, 21, and 22 and the rivets 67 allow the panel portion of the gate 52 to move or rack to an angle relative to the rails 13, 14 and the posts 50. The distal ends 60, 64 of the respective rails 13, 14 received in the post 50 cooperate with the opposing welds 18, 19 to resist the rails 13, 14 from pivoting outwardly from the pickets 16, 16' when the panel racks. As illustrated in FIG. 10, hinges 74 connect one post 50*a* in the gate 52 to an adjacent post 12*a* in the fence panel 11*a* of the fence 72. The latch member 58 attaches to the post 12*b* of the opposing fence panel 11*b* adjacent the post 50*b* in the gate for selective engagement with the latch 56 on the post 50*b*.

In another aspect, the gate 52 that tracks a sloped grade during installation of a fence over a terrain may be made as follows. The rails 13, 14 are disposed parallel and spaced-apart at an angle to a horizontal plane to define a longitudinal length of a gate panel, with the rails 13, 14 defining opposing first and second side edges 25, 26. A plurality of first pickets 16 (or the inner pickets 16) attach to the rails 13, 14 substantially perpendicular to the horizontal plane with fasteners, such as welds, between the first pickets and the first side edge 25 of the rails. A second picket 16' (or the outer picket 16') attaches at respective end portions of the rails substantially perpendicular to the horizontal plane by fasteners, such as welds, between the second picket and the second side edge of the rails. The distal ends 60, 62 and 64, 66 of the rails 13, 14 are received and pivotally secured in the openings 54 defined in the opposing posts 50.

It is to be appreciated that the fastening of the second (or outer picket) 16' is opposed to the fastening of the first pickets 16 on the respective rail. The fastening of the first pickets to the first rail may be on the same side edge as the second rail, or, as illustrated, may be on opposing side edges. The second picket 16' is fastened on a side edge opposing the fastening of the first pickets 16.

The gate 52 is completed by attaching the hinges 74 and the latch 56 to the post 50 for connecting to the fence posts 12*b* and 12*a*. During installation, the gate 52 is racked, such as by moving the opposing posts 50 in opposing directions transverse to the longitudinal axis of the rails 13, 14. This conforms the slope of the rails 13, 14 substantially to the slope of the portion of the terrain by changing the angle between the pickets 16, 16' and the rails 13, 14 while the pickets remain substantially perpendicular to horizontal, as illustrated in FIG. 10.

While this invention has been described in detail with particular references to the preferred embodiments thereof, it should be understood that many modifications, additions and deletions, in addition to those expressly recited, may be made thereto without departure from the spirit and scope of the invention.

What is claimed is:

1. A rackable gate for a fence on terrain having a non-level contour, comprising:

a gate panel with spaced-apart rails that each define a lateral side and a first edge and a second edge thereof, the first edge spaced apart from the second edge, and a plurality of spaced-apart parallel first pickets sitting on the lateral side and fastened thereto only between the respective first picket and the first edge;

at least one second picket disposed parallel and spaced from an adjacent one of the first pickets sitting on the lateral side of the rails and fastened thereto only between the respective second picket and the second edge;

a pair of opposing gate posts, each defining openings in a side wall, the openings being spaced-apart to conform to the spacing of the rails, the openings receiving opposing distal ends of the rails and pivotally secured thereat, whereby during racking of the gate panel by moving the gate posts in opposing directions parallel to a longitudinal axis of the second pickets to orient the rails at an oblique angle relative to the first and second pickets to track the contour of the terrain, the fastening of the second picket on the second edge opposing the fastening of the first pickets on the first edge and the opposing ends of the rails received in the gate posts cooperatively restrict the rails from pivoting laterally from the pickets.

2. The rackable gate as recited in claim 1, wherein the fastening of the pickets at the first and second edges comprise flexible mild steel welds.

3. The rackable gate as recited in claim 1, wherein the gate panel is selectively racked during installation between about 0 and 20 degrees relative to an angle at which the rails are disposed when the rails and pickets are initially fastened together.

4. The rackable gate as recited in claim 1, wherein the angle at which the rails are disposed is between about 0 degrees and 60 degrees.

5. The rackable gate as recited in claim 4, wherein the gate panel is selectively racked during installation between about 0 and 20 degrees relative to the angle at which the rails are disposed when the rails and pickets are initially attached together.

6. The rackable gate as recited in claim 1, wherein the angle at which the rails are disposed is selected from the group consisting of the angles of about 0 degrees, about 20 degrees, about 40 degrees, and about 60 degrees.

7. The rackable gate as recited in claim 6, wherein the gate panel is selectively racked during installation between about 0 and 20 degrees relative to the angle at which the rails are disposed when the rails and pickets are initially attached together.

8. The rackable gate as recited in claim 1, wherein the rails are four-wall tubular members.

9. A rackable gate readily adjustable to track substantially a slope of a terrain during installation thereof in a fence, comprising:

a first elongate rail and a second elongate rail disposed in parallel spaced-apart relation and at an angle relative to horizontal to define a longitudinal length of a gate panel, the rails each defining a lateral side surface and opposing first and second side edges spaced-apart thereof;

a plurality of first pickets disposed in parallel and spaced-apart relation, sitting on the lateral side surface of the rails and attached to the first and the second rails by a fastener only between the respective first picket and the first side edge of the rails;

at least one second picket disposed in parallel and spaced-apart relation to an adjacent one of the first pickets and attached to the first and the second rails by a fastener only between the second picket and the second side edge of the rails; and opposing gate posts defining openings in which respective distal ends of the rails are pivotally secured, whereby the rackable gate during installation in a fence over a terrain is adjustable to the slope of a portion of the terrain by moving opposing ends of the gate panel in opposing directions transverse to a longitudinal axis of the rails while the pickets remain substantially perpendicular to horizontal and the fastening of the second picket on the second edge opposing the fastening of the first pickets on the first edge restrict the rails from pivoting laterally away from the first and second pickets.

10. The rackable gate as recited in claim 9, wherein the fasteners attaching the first and second pickets to the rails at the respective first and second edges comprise flexible mild steel welds.

11. The rackable gate as recited in claim 10, wherein the angle at which the rails are disposed is between about 0 degrees and 60 degrees.

12. The rackable gate as recited in claim 11, wherein the gate panel is selectively racked during installation between about 0 and 20 degrees relative to the angle at which the rails are disposed when the rails and pickets are initially attached together.

13. The fence panel as recited in claim 10, wherein the rails are four-wall tubular members.

14. A method of making a gate for tracking a sloped grade during installation of a fence over a terrain, comprising the steps of:

(a) disposing a first rail parallel and spaced-apart from a second rail at an angle to a horizontal plane to define a longitudinal length of a fence panel, the rails each defining a lateral side surface having opposing first and second side edges spaced-apart thereof (b) sitting a plurality of first pickets onto the lateral side surface of the rails substantially perpendicular to the horizontal plane;

(c) attaching the first pickets thereto with a fastener only between the first pickets and the first side edge of the rails;

(d) sitting a second picket onto the lateral side surface of the rails substantially perpendicular to the horizontal plane (e) attaching the second picket thereto with a fastener only between the second picket and the second side edge of the rails; and (f) pivotally securing distal ends of the rails to opposing posts, whereby the gate, being racked by moving the opposing posts in opposing directions transverse to a longitudinal axis of the rails, conforms the slope of the rails substantially to the slope of the portion of the terrain by changing the angle between the pickets and the rails in a plane defined by the lateral side surface of the rails while the pickets remain substantially perpendicular to horizontal and the fastening of the second picket on the second edge opposing the fastening of the first pickets on the first edge restrict the rails from pivoting laterally from the pickets.

* * * * *